US005937759A

United States Patent [19]

Mitsam et al.

[11] Patent Number: 5,937,759

[45] Date of Patent: Aug. 17, 1999

[54] STAMPING ROLLER FOR A STAMPING DEVICE

[76] Inventors: Reinwald Mitsam, Cadolzburger Weg 15, D-90759 Langenzenn; Johannes Georg Schaede, Max-Heim-Strasse 8, D-97074 Würzburg, both of Germany

[21] Appl. No.: 08/981,136

[22] PCT Filed: Apr. 6, 1996

[86] PCT No.: PCT/DE96/00649

§ 371 Date: Nov. 25, 1997

§ 102(e) Date: Nov. 25, 1997

[87] PCT Pub. No.: WO97/01442

PCT Pub. Date: Jan. 16, 1997

[30] Foreign Application Priority Data

Jun. 28, 1995 [DE] Germany ..... 195 23 441

[51] Int. Cl.[6] ..... B41F 13/10

[52] U.S. Cl. ..... 101/378; 101/22; 101/375

[58] Field of Search ..... 101/375, 378, 101/327, 328, 329, 5, 22, 28

[56] References Cited

U.S. PATENT DOCUMENTS 3,590,452 7/1971 Macleod ..... 29/115
3,693,544 9/1972 Trzyna ..... 101/375
4,917,103 4/1990 Katz ..... 101/375
5,706,731 1/1998 Francille et al. ..... 101/375

*Primary Examiner*—Edgar Burr
*Assistant Examiner*—Dave A. Ghatt
*Attorney, Agent, or Firm*—Louis E. Marn

[57] ABSTRACT

Described is a stamping roller (10) intended for a stamping apparatus, which roller has a central carrier roller (12) and stamping punch portions (24) which are spaced from each other in the peripheral direction, wherein fixed to the carrier roller is at least one punch ring whose two axially mutually spaced edge portions are designed with spacer rings (26) for the defined contact of at least one associated backing roller (28), and the punch ring (20) is designed with the stamping punch portions (24) between the two spacer rings (26). The/each punch ring (20) is matched to the carrier roller (12) in respect of dimensions and material in such a way that the/each punch ring (20) is displaceable on the carrier roller (12) at ambient temperature and at elevated stamping or operating temperature of the stamping roller (10) thermal expansion fixes the/each punch ring (20) on the carrier roller (12). The or each punch ring (20) has a heat-insulation portion between the two lateral spacer rings (26) and between adjacent punch portions (24). Lateral cover means (34) adjoin the/each punch ring (20).

5 Claims, 4 Drawing Sheets

STAMPING ROLLER FOR A STAMPING DEVICE

BACKGROUND OF THE INVENTION

1. Field of Invention

The invention concerns a stamping roller intended for a stamping apparatus, which has a central carrier roller and stamping punch portions which are spaced from each other in the peripheral direction, wherein fixed to the carrier roller is at least one punch ring whose two axially mutually spaced edge portions are designed with spacer rings for the defined contact of at least one associated backing roller, and the at least one punch ring is designed with the stamping punch portions between the two associated spacer rings.

2. Description of the Prior Art

A stamping roller, or embossing roller, is known from WO 94/13487 A1, in which a specific stamping roller is required for different substrates to be stamped or embossed, according to the way in which the substrates are respectively divided up into respective pieces or portions. That means that a known stamping roller of that kind is only suitable for stamping large numbers of items because such stamping rollers are expensive and so-to-speak exhibit no flexibility. In addition, when such a known stamping roller is of large dimensions, minimal deviations from the ideal cylindrical shape, as can occur for example due to temperature influences, can give rise to considerable quality problems in the stamping operation, that is to say in the respective operation for transferring decoration from the stamping foil onto the substrate, because the pressure or backing rollers which press against the stamping roller can provide for only limited compensation in respect of such deviations from the ideal cylindrical shape for the stamping roller, or tolerance compensation.

A stamping roller intended for a stamping apparatus is known from German patent specification No. 233 239, which stamping roller has a central carrier roller and stamping punch portions which are spaced from each other in the peripheral direction, wherein a number of punch rings are fixed to the carrier roller in closely adjacent relationship. The punch rings are arranged between two lateral spacer rings. Those two lateral spacer rings serve therein not for defined contact of an associated backing roller, but for passing through and securing fixing bars for holding together the punch rings which are arranged in closely adjacent relationship.

DE 27 53 296 C2 describes a slur ring arrangement for producing a defined interaxial spacing between two printing mechanism cylinders of a rotary printing mechanism with two slur rings mounted at a respective end of each of the two printing mechanism cylinders and which rotate with the printing mechanism cylinders and which can roll against each other in a prestressed condition and with continuous contact with each other, at least one thereof being fixed with its central bore on the shaft of the associated printing mechanism cylinder. To prevent slur ring wear it is proposed therein that in the case of the slur ring which is fixed on the shaft of the printing mechanism cylinder, the support surface at the shaft of the printing mechanism cylinder is convex and the support surface in the central bore of the slur ring is correspondingly concavely curved.

DE 85 18 933 U1 discloses a stamping roller with a heatable roller core and a roller shell which is supported thereon and which is engraved on its peripheral surface, wherein the roller core, at least in the region of its support with the roller shell, comprises a material with a higher coefficient of thermal expansion than the roller shell.

The object of the present invention is that of providing a stamping roller of the kind set forth in the opening part of this specification, in which a variable arrangement of the stamping punch portions is possible as desired and in which tolerances or possible deviations from the ideal cylindrical shape of the stamping roller and truth-of-rotation thereof can be compensated, using simple means.

In a stamping roller of the kind set forth in the opening part of this specification, in accordance with the invention, that object is attained in that the/each punch ring is matched to the carrier roller in respect of dimensions and material in such a way that the/each punch ring is displaceable on the carrier roller at ambient temperature and at elevated stamping or operating temperature of the stamping roller thermal expansion fixes the/each punch ring on the carrier roller, that the/each punch ring has a heat-insulation portion between the two lateral spacer rings and between adjacent stamping punch portions, and that cover means laterally adjoin the/each punch ring.

In that arrangement, the stamping punch portions are desirably disposed equidistantly in the peripheral direction of the punch ring. A punch ring can be fixed to the central carrier roller but preferably a plurality of punch rings are fixed to the central carrier roller. By virtue of the fact that the stamping punch portions are provided on punch rings, it is possible for a suitable number of punch rings to be arranged as desired on the central carrier roller. In that respect, the axial spacing between the adjacent punch rings can be easily adjusted as desired. The selection of a suitable punch ring also makes it possible for example to select as desired the pitch or the mutual spacing of the stamping punch portions in the peripheral direction of the stamping roller. Because the respective pressure or backing roller bears in a defined manner against the two lateral spacer rings between which the stamping punch portions are disposed, that gives the advantage that tolerances in the stamping roller or deviations in the stamping roller from an exact cylindrical shape and thus deviations from precise rotational truth of the stamping roller can be easily compensated. It will be appreciated that it is also possible for not just one pressure or backing roller to bear against the corresponding punch ring, but a number of pressure or backing rollers, similarly to a design configuration of a stamping apparatus as is disclosed in DE 32 10 551 C2.

At normal abient temperature there is a sliding or push fit tolerance between the respective punch ring and the central carrier roller, so that the respective punch ring is displaceable as desired in the axial direction of the central carrier roller. The choice of material for the punch ring and the central carrier roller is such that, at the elevated operating or stamping temperature of the stamping roller, the central carrier roller expands to a greater degree than the/each punch ring, so that there is a press fit between the central carrier roller and the/each punch ring at the stamping or operating temperature of the stamping roller, whereby the/each punch ring is fixed on the central carrier roller.

Desirably, the/each punch ring is provided with a heating device. The heating device may be an electrical heating device. By means of such a heating device, it is possible to provide for accurate regulation of the temperature at the stamping punch portions of the respective punch ring and in particular precise regulation of the temperature at the front or punching surfaces of the individual stamping punch portions. For the purposes of accurate temperature regulation of the individual stamping punch portions of the/each punch ring, the respective punch ring is desirably provided with temperature-measuring sensors connected to a regulating device which suitably acts on said heating device.

Thermal separation between the stamping punch portions or the front or stamping surfaces thereof can be achieved by the/each punch ring having a heat-insulation portion between the two lateral spacer rings and between the adjacent stamping punch portions. Those heat-insulation portions advantageously have an outside surface which corresponds to the outside surface of the stamping roller. That affords the advantage that the substrate which is to be stamped and the stamping foil which is introduced simultaneously with the substrate between the stamping roller and the at least one associated pressure or backing roller cannot suffer from any undesired folding into the intermediate spaces between adjacent stamping punch portions, which folding would adversely affect the quality of the stamping. The above-mentioned heat-insulation portions have insulating properties such that the surface temperature of the heat-insulation portions does not exert any effect, that is to say influence, on the stamping foil, so that the heat-insulation portions do not give rise to any undesired preliminary activation of the adhesive layer and/or stretching of the carrier of the stamping foil.

While, in the case of a smooth stamping roller as is disclosed for example in above-mentioned DE 32 10 551 C2, the pressure or backing rollers continuously and uniformly roll against the cylindrical peripheral surface, the rolling movement is correspondingly discontinuous in the case of a stamping roller with spaced-apart, individual stamping punch portions. In other words, at the pressures required for carrying out the stamping operation, the backing or pressure rollers can be moved into the intermediate spaces between adjacent stamping punch portions. The heat-insulation portions disposed between adjacent stamping punch portions are not suitable for applying the necessary counteracting forces; more specifically, due to the material used, they yield or deflect slightly. Serious problems can arise, in particular in the event of so-called distortion of the stamping roller, as often cannot be reliably excluded in consideration of the temperatures employed. It is here that the present invention, using simple means, provides a reliable remedy by virtue of the fact that disposed laterally beside the spaced-apart stamping punch portions are the two spacer rings against which the at least one associated pressure or backing roller of the stamping apparatus presses. When dealing with sensitive substrates to be stamped and/or when using high line pressures between the stamping roller and the at least one pressure or backing roller, the spacer rings can leave behind on the stamped substrate clearly marked impressions which can then limit the capacity for overprinting. In order to remedy that disadvantage, the two spacer rings of the/each punch ring in the stamping roller according to the invention can be provided with chamfer surfaces. Designing the respective pair of spacer rings with such chamfer surfaces affords the advantage that overprintability is not restricted.

SUMMARY OF THE INVENTION

In the stamping roller according to the invention, the cover means can each comprise a respective metal sheet. They serve not only to provide a suitable configuration for the stamping cylinder, but in addition they also serve to provide for thermal insulation for the central carrier roller, in an outward direction. More specifically, the carrier roller is desirably also provided with a heating device. The heating device may be formed for example by commercially available electrical heating cartridges or inserts.

It has been found advantageous if at least one elongate bar element projects away from the stamping roller according to the invention, that is to say from the outside peripheral surface of its central carrier roller, which bar element is oriented in the axial direction of the carrier roller and is formed laterally beside the at least one punch ring with suction openings. By means of the suction openings which can be brought into fluid communication with a reduced-pressure source by way of suitable hose conduits, it is reliably possible to fix a substrate to be stamped, to the stamping roller. In this case, in the operation of stamping a so-called endless substrate, the advance movement of the substrate is guaranteed in particular by a suitable clamping effect as between the spacer rings of the/each punch ring and the associated pressure or backing rollers. When stamping substrates in sheet form, that is to say in the form of individual portions, substrate transportation is effected in particular by the elongate bar elements with their suction openings. In that case, the leading part of the sheet or individual portion is desirably engaged in a defined manner by means of the suction openings. In that case, the sheets or portions are pushed onto the at least one bar element for example by a feed roller which is arranged upstream of the stamping station. In order precisely definedly to limit that advance movement, it is preferable if, in a stamping roller of the last-mentioned kind, the at least one bar element has abutment ribs which are disposed laterally beside the at least one punch ring and which project radially beyond the at least one punch ring. The respective sheet to be stamped comes to bear against those abutment ribs, by way of its front edge, in an accurately defined position, and is sucked against the bar element and thus against the stamping roller by way of the suction openings in the elongate bar element. After the corresponding stamping operation has been carried out, the reduced pressure is discontinued. After that, compressed air can be blown out through the suction openings, whereby the stamped substrate sheets or individual portions are ejected from the abutment ribs or the stamping roller and are taken over for example by conveyor belts.

OBJECTS OF THE INVENTION

The stamping roller according to the invention consequently has a large number of advantages, such as:

- time-saving interchangeability of a complete punch ring for another punch ring with a desired stamping punch portion shape and pitch arrangement;
- stamping roller diameter and periphery variable within certain limits;
- rapid attainment of a stable operating temperature by separate heating of the carrier roller and the at least one punch ring;
- secure reliable mounting and fixing of the at least one punch ring on the central carrier roller as a result of the press fit at the elevated operating temperature of the stamping roller;
- reliable and secure substrate transportation both when dealing with endless substrate material and also when dealing with substrate material in sheet form or in the form of individual portions because the clamping action is produced directly laterally beside the individual punch portion surfaces or stamping punch portions;
- no problems due to distortion of the stamping roller;
- stampability, without problems, of substrates of different thicknesses because the associated spacer rings are disposed immediately beside the individual stamping punch portions so that defined conditions are afforded not only at the outer edges of the stamping roller but also directly laterally beside each of the stamping punch portions; and avoiding undesired changes in the print image with changes in stamping temperature and consequently a change in the diameter of the stamping roller.

Further advantages of the stamping roller according to the invention are that the temperature at the front or punching surfaces of the stamping punch portions can be very accurately and easily regulated and that thermal separation can be easily effected by means of heat-insulation portions between said stamping surfaces of the stamping punch portions and the non-stamping intermediate spaces between the stamping punch portions. The heat-insulation portions are to be of a cylindrical shape in order to keep the length of the foil which is drawn off, corresponding to the arcuate length of the cylindrical configuration, as, without such heat-insulation portions, the foil would follow the polygonal shape from one punch portion to another. As a result of this, the length of foil drawn off would be shorter than the pitch arrangement or spacing of the punch portions on the cylinder or the pitch arrangement of the imprints on the sheet of paper or the like, which is to be stamped. That would severely impair regulatability. The last-mentioned deficiencies are eliminated in a simple fashion, by virtue of the provision of the heat-insulation portions.

BRIEF DESCRIPTION OF THE DRAWINGS

Further details, features and advantages are apparent from the following description of an embodiment, illustrated in the drawing, of the stamping roller according to the invention. In the drawing.

DETAILED DESCRIPTION OF THE DRAWINGS

Figure 1:
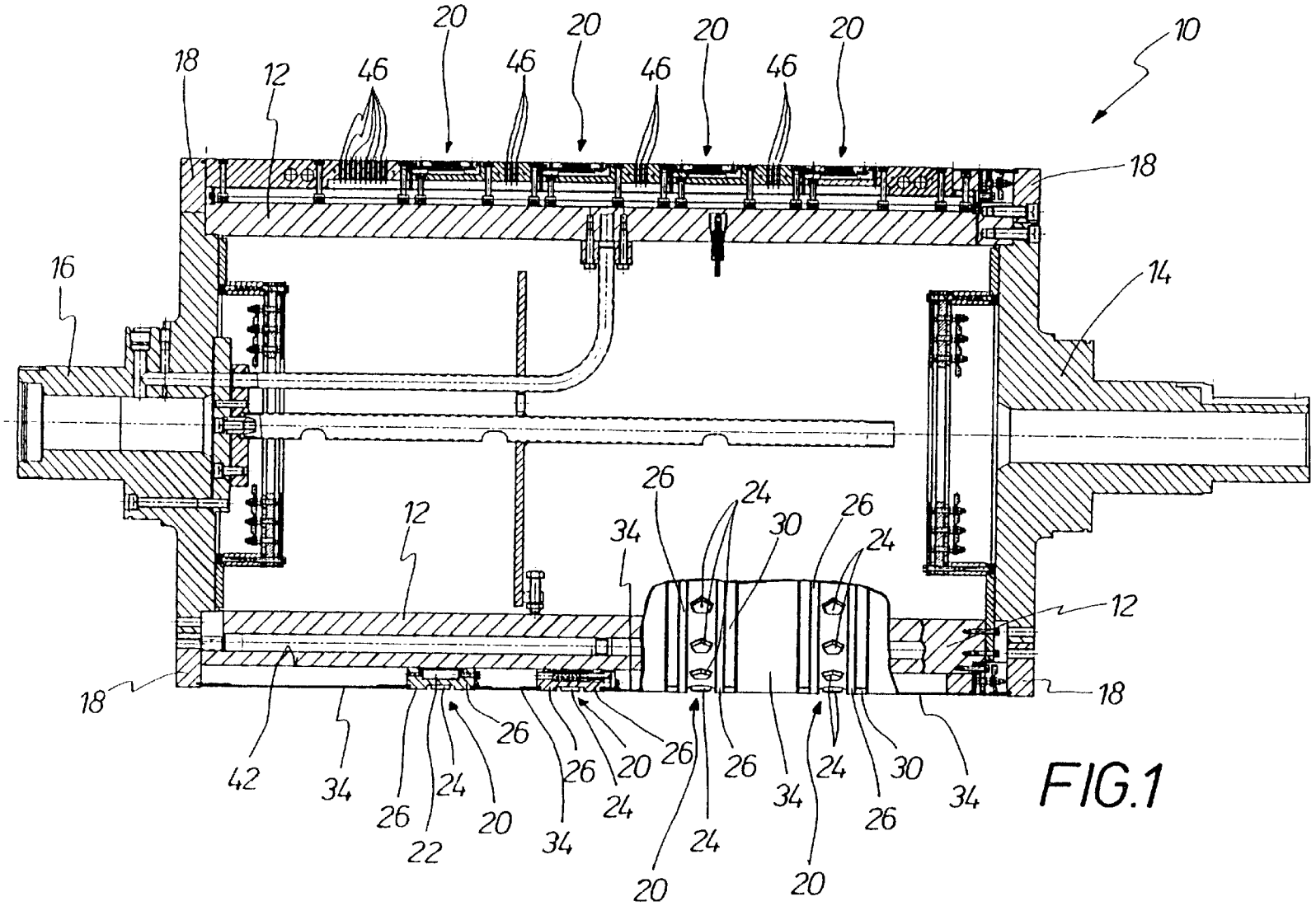
FIG. 1 is a view, which for the major part is cut away, of an embodiment of the stamping roller having four punch rings.

FIG. 1 shows an embodiment of the stamping roller 10 which is intended for a stamping apparatus, having a central carrier roller 12 which is in the form of a tubular sleeve. A flange 14, 16 is fixed to each of the two axial ends of the central carrier roller 12. The flange 14 is the flange at the drive end. The stamping roller 10 is driven by way of the flange 14. The drive is provided by way of a non-rotatable divisible coupling which is not shown in FIG. 1. Such a design configuration with divisible coupling gives the advantage that the stamping roller 10 can be replaced, in a time-saving manner.

Fixed to the two axial ends of the stamping roller 10 or to the flanges 14, 16 are spacer or runner or slur rings 18 which determine the diameter of the stamping roller 10. Those spacer rings 18 serve to support a backing roller carrier (not shown) of the stamping apparatus.

Figure 3:
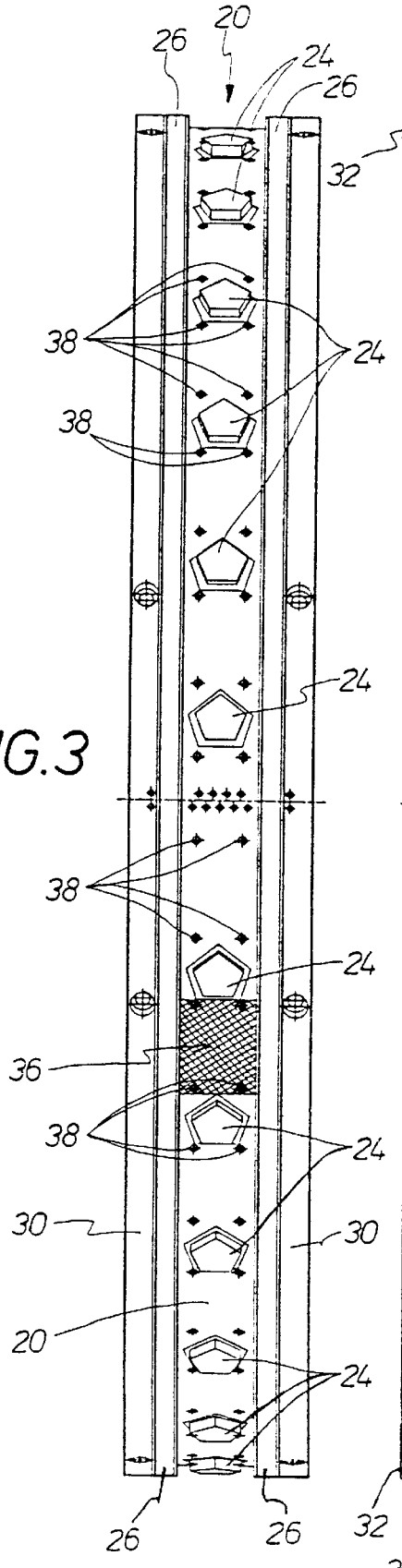
FIG. 3 is a side view of a punch ring of the stamping roller shown in FIG. 1.
Figure 4:
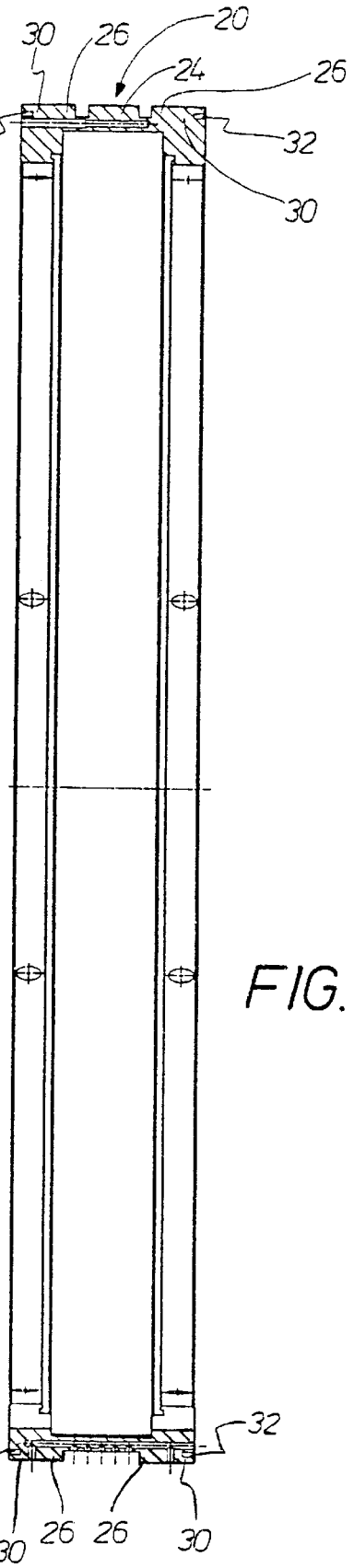
FIG. 4 shows an angled section through the punch ring shown in FIG. 3.

Fixed to the tubular central carrier roller 12 are four punch rings 20 of which one is shown in FIGS. 3 and 4 in a side view and in section. The punch rings 20 are spaced from each other in the axial direction and, in terms of dimensions and material, are matched to the central carrier roller 12 in such a way that each punch ring 20 is slidable or displaceable on the central carrier roller 12 at ambient temperature while at elevated stamping or operating temperature of the stamping roller 10 thermal expansion fixes the respective punch ring 20 on the central carrier roller 12. The central carrier roller 12 therefore comprises a material which has a higher coefficient of thermal expansion than the material for the punch rings 20.

Each punch ring 20 is provided with a heating device 22. These heating devices are desirably electrical resistance heating devices. The power thereof is such that the entire process heat can be applied. Each of the punch rings 20 has its own electrical regulating circuit so that the individual punch rings can not only be replaced without problem, but they can also be regulated independently of each other as desired.

As can be seen from FIGS. 1 and 3, each punch ring 20 is formed with a row of stamping punch portions 24 which are spaced from each other. Laterally beside the stamping punch portions 24 the/each punch ring 20 is formed with spacer rings 26 against which the respectively associated backing roller 28 (see FIG. 5) bears. A side portion 30 laterally integrally adjoins each of the two spacer rings 26. Each of the two side portions 30 has a peripherally extending annular groove 32 which is provided for fixing an associated lateral cover means 34.

A respective heat-insulation portion 36 is disposed between adjacent stamping punch portions 24 and the two lateral spacer rings 26. One of those heat-insulation portions 36 is indicated by hatching in FIG. 3. The heat-insulation portions 36 are for example screwed fast between the two spacer rings 26, as is indicated by references 38.

Figure 5:
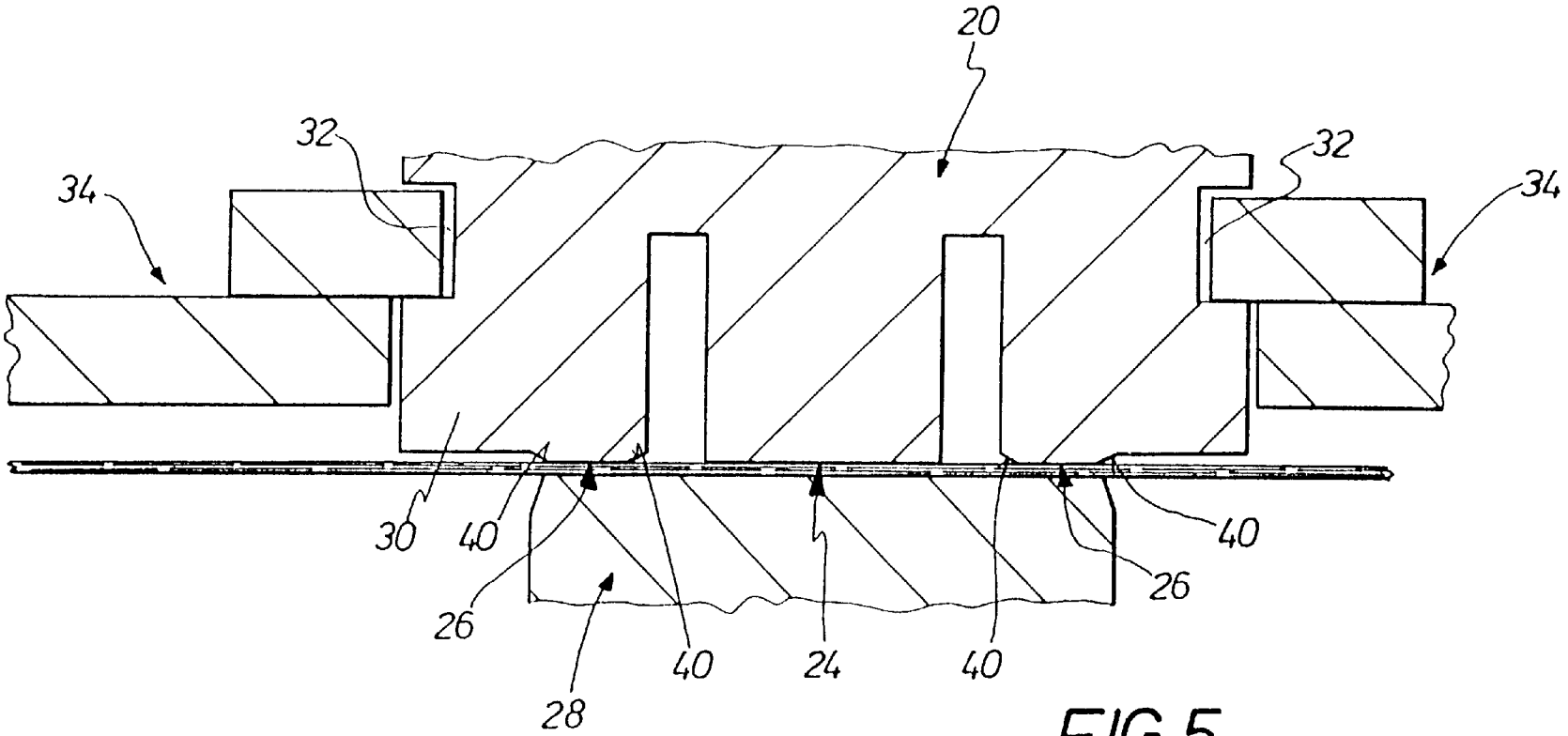
FIG. 5 is a heavily distorted sectional view, not true to scale, of a portion of a punch ring and an associated pressure or backing roller.

As can be seen from FIG. 5, the two spacer rings 26 of the corresponding punch ring 20 are provided with chamfer surfaces 40.

Figure 2:
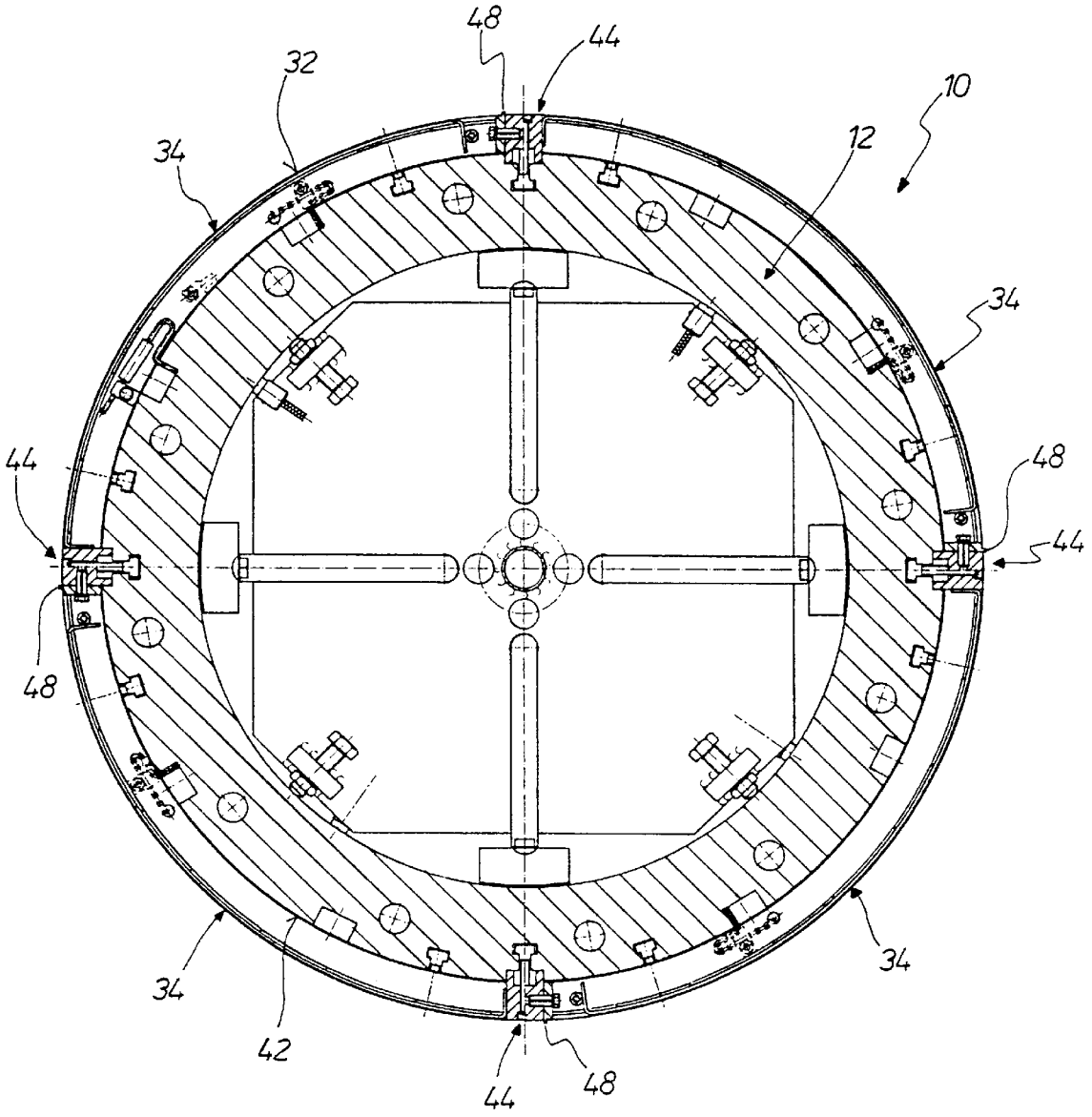
FIG. 2 is a view in cross-section through the stamping roller shown in FIG. 1.

As can be seen from FIG. 2, four elongate bar elements 44 project away from the outside peripheral surface 42 of the central carrier roller 12; the bar elements 44 are provided laterally beside the punch rings 20 with suction openings 46, as FIG. 1 shows. The elongate bar elements 44 also have abutment ribs 48 (see FIG. 2) which are disposed laterally beside the punch rings 20 and which project radially beyond the punch rings 20. The abutment ribs 48 serve for accurately defined contact with the front edge of each substrate to be stamped, which is in sheet form or in the form of an individual portion.

We claim:

1. A stamping roller (10) for a stamping apparatus having a central carrier roller (12) with stamping punch portions (24), wherein said stamping punch portions (24) being spaced from each other in a peripheral direction, and at least one punch ring (20) fixed to said carrier roll (12), each of said at least one punch rings (20) containing spacer rings (26) at two mutually axially-spaced edge portions thereof for defined contact with at least one associated backing roller (28), and wherein said at least one punch ring (20) contains said stamping punch portions (24) between said spacer rings (26) wherein each of said at least one punch ring (20) has a first coefficient of thermal expansion and said carrier roller (12) has a second coefficient of thermal expansion different from the first coefficient of thermal expansion such that each of said at least one punch ring (20) is mounted over said carrier roller (12) is displaceable relative to said carrier roller (12) at ambient temperature and at an elevated stamping operating temperature of said stamping roller (10), said punch ring (20) being securely fixed to said carrier roller (12) and wherein said each punch ring (20) further comprises a heat insulating portion (36) between said lateral spacer rings (26) and between adjacent stamping punch portions (24), said stamping roller further comprising cover means (34) laterally adjoining each punch ring.

2. A stamping roller according to claim 1 wherein said punch ring (20) is provided with a heating device (22).

3. A stamping roller according to claim 2 further comprising at least one elongate bar element (44) oriented in the axial direction of said carrier roller (12) wherein said stamping roller has an outside peripheral surface (42) from which said elongate bar element (44) projects, said elongate bar element (44) is provided laterally beside said at least one punch ring (20) with suction openings (46).

4. A stamping roller according to claim 3 wherein said at least one bar element (44) has abutment ribs (48) which are provided laterally beside said at least one punch ring (20) and which project radially beyond said at least one punch ring (20).

5. A stamping roller according to claim 1 or 2 wherein said two spacer rings (26) of said each punch ring (20) are provided with chamfer surfaces (40).

* * * * *